US011641919B2

(12) United States Patent
Vu et al.

(10) Patent No.: US 11,641,919 B2
(45) Date of Patent: May 9, 2023

(54) NAIL LAMP

(71) Applicant: Revlon Consumer Products Corporation, New York, NY (US)

(72) Inventors: Thong Vu, Vista, CA (US); Daniel Moore, Escondido, CA (US)

(73) Assignee: Revlon Consumer Products Corporation, New York, NY (US)

( * ) Notice: Subject to any disclaimer, the term of this patent is extended or adjusted under 35 U.S.C. 154(b) by 226 days.

(21) Appl. No.: 17/116,605

(22) Filed: Dec. 9, 2020

(65) Prior Publication Data

US 2021/0085054 A1 Mar. 25, 2021

Related U.S. Application Data

(63) Continuation of application No. PCT/US2019/036528, filed on Jun. 11, 2019.

(60) Provisional application No. 62/744,271, filed on Oct. 11, 2018, provisional application No. 62/686,168, filed on Jun. 18, 2018, provisional application No. 62/683,067, filed on Jun. 11, 2018.

(51) Int. Cl.

| | |
|---|---|
| ***A45D 29/00*** | (2006.01) |
| ***F21V 7/00*** | (2006.01) |
| ***F21V 7/05*** | (2006.01) |

(52) U.S. Cl.

CPC ..... *A45D 29/00* (2013.01); *F21V 7/0075* (2013.01); *F21V 7/0083* (2013.01); *F21V 7/05* (2013.01); *A45D 2200/205* (2013.01)

(58) Field of Classification Search

CPC ..... A45D 2200/205

See application file for complete search history.

(56) References Cited

U.S. PATENT DOCUMENTS

| | | | |
|---|---|---|---|
| 826,643 | A | 7/1906 | Young |
| 2,218,296 | A | 10/1940 | Perras |
| 2,262,274 | A | 11/1941 | Fingerlin |
| 3,179,795 | A | 4/1965 | Angle |
| 3,864,847 | A | 2/1975 | Friedman et al. |
| 3,884,847 | A | 5/1975 | Pruvost et al. |
| 4,193,209 | A | 3/1980 | Lovison et al. |

(Continued)

FOREIGN PATENT DOCUMENTS

| | | | |
|---|---|---|---|
| CA | 2340209 | A1 | 9/2002 |
| CN | 201227850 | Y | 4/2009 |

(Continued)

OTHER PUBLICATIONS

Extended European Search Report for European Patent Application No. 15846788.6, dated Jul. 10, 2018 (5 pages).

(Continued)

*Primary Examiner* — Sean P Gramling

(74) *Attorney, Agent, or Firm* — Maheen Baber

(57) ABSTRACT

A nail lamp is configured to cure light-curable nail product on a user's nails. The lamp includes an array of discrete light sources. A nail treatment space is disposed beneath the array and is sized to accommodate therein at least one nail of a user so as to expose the user's at least one nail to light from the array. The nail lamp includes a number of features to improve the uniformity of exposure of the at least one user nail to light relative to existing lamps. These features include one or more angled surfaces and light reflectors.

14 Claims, 18 Drawing Sheets

(56) References Cited

U.S. PATENT DOCUMENTS

| | | | |
|---|---|---|---|
| 4,754,769 | A | 7/1988 | Flynn |
| D300,960 | S | 5/1989 | Billings |
| 4,967,775 | A | 11/1990 | Kaiser |
| 4,979,523 | A | 12/1990 | Grimm |
| 4,987,310 | A | 1/1991 | Oppawsky et al. |
| 5,084,984 | A | 2/1992 | Duchoud et al. |
| 5,103,845 | A | 4/1992 | Matthews |
| 5,249,367 | A | 10/1993 | Nafziger et al. |
| 5,336,128 | A | 8/1994 | Birdsong |
| 5,515,621 | A | 5/1996 | Bloom |
| 6,035,860 | A | 3/2000 | Mombourquette |
| D431,682 | S | 10/2000 | Seo |
| D453,858 | S | 2/2002 | Tsai |
| 6,518,583 | B1 | 2/2003 | Hennig |
| D489,489 | S | 5/2004 | Khalaj |
| D492,447 | S | 6/2004 | Mills |
| 6,826,848 | B1 | 12/2004 | Delaney et al. |
| 7,118,589 | B2 | 10/2006 | Vlahos |
| 7,712,473 | B1 | 5/2010 | Robinson et al. |
| D661,021 | S | 5/2012 | Chang |
| D661,429 | S | 6/2012 | Huthmaker |
| 8,242,475 | B1 | 8/2012 | Cheng |
| 8,286,643 | B2 | 10/2012 | Li et al. |
| 8,312,641 | B2 | 11/2012 | Li et al. |
| 8,450,705 | B1 | 5/2013 | Chen et al. |
| 8,696,161 | B2 | 4/2014 | Pan et al. |
| 8,739,431 | B2 | 6/2014 | Cheng |
| 8,835,886 | B2 | 9/2014 | Vu et al. |
| 9,149,106 | B2 | 10/2015 | Park |
| 9,562,665 | B2 | 2/2017 | Ebner |
| 9,618,182 | B2 | 4/2017 | Ebner et al. |
| 9,713,371 | B1 | 7/2017 | Luu |
| 9,841,233 | B2 | 12/2017 | Valia et al. |
| 10,393,433 | B2 | 8/2019 | Valia et al. |
| 10,408,537 | B2 | 9/2019 | Haile et al. |
| 10,506,861 | B1 | 12/2019 | Ma |
| 2002/0181947 | A1 | 12/2002 | Cao |
| 2004/0101802 | A1 | 5/2004 | Scott |
| 2006/0260628 | A1 | 11/2006 | Chan |
| 2008/0172045 | A1 | 7/2008 | Shanks et al. |
| 2009/0143842 | A1 | 6/2009 | Cumbie et al. |
| 2009/0160923 | A1 | 6/2009 | Custer |
| 2010/0293805 | A1 | 11/2010 | Chang |
| 2011/0248187 | A1 | 10/2011 | Wang et al. |
| 2011/0277338 | A1* | 11/2011 | Li ..... F26B 9/003 34/275 |
| 2012/0060757 | A1 | 3/2012 | Li et al. |
| 2012/0187311 | A1 | 7/2012 | Vu et al. |
| 2013/0013444 | A1 | 1/2013 | Vandikas et al. |
| 2013/0020509 | A1 | 1/2013 | Horvath et al. |
| 2013/0109001 | A1 | 5/2013 | Pan et al. |
| 2013/0161531 | A1 | 6/2013 | Haile |
| 2013/0255100 | A1 | 10/2013 | Valia et al. |
| 2014/0054472 | A1 | 2/2014 | Tanihara et al. |
| 2014/0124655 | A1 | 5/2014 | Rivero et al. |
| 2014/0168972 | A1 | 6/2014 | Ebner |
| 2014/0194955 | A1 | 7/2014 | Povolosky et al. |
| 2014/0231848 | A1 | 8/2014 | Tischler et al. |
| 2016/0370113 | A1 | 12/2016 | Valia |
| 2017/0343282 | A1 | 11/2017 | Valia et al. |
| 2017/0354235 | A1 | 12/2017 | Miller |
| 2019/0195558 | A1 | 6/2019 | Valia et al. |

FOREIGN PATENT DOCUMENTS

| | | | |
|---|---|---|---|
| CN | 102935422 | A | 2/2013 |
| CN | 202778914 | U | 3/2013 |
| CN | 103596464 | A | 2/2014 |
| CN | 203801932 | U | 9/2014 |
| CN | 107334250 | A | 11/2017 |
| CN | 107874433 | A | 4/2018 |
| DE | 202004008982 | U1 | 8/2004 |
| DE | 202006005790 | U1 | 6/2006 |
| EP | 2979570 | A1 | 2/2016 |
| JP | 2011098073 | A | 5/2011 |
| RU | 90301 | U1 | 1/2010 |
| TW | M424054 | U | 3/2012 |
| WO | 2005068509 | A1 | 7/2005 |
| WO | 2005120286 | A1 | 12/2005 |
| WO | 2007115666 | A1 | 10/2007 |
| WO | 2013149156 | A3 | 11/2013 |
| WO | 2015049845 | A1 | 4/2015 |
| WO | 2019241233 | A1 | 12/2019 |

OTHER PUBLICATIONS

First Office Action for Chinese Patent Application No. 201580065817.X, dated Nov. 14, 2018, with English translation (17 pages).

International Search Report and Written Opinion received for International Patent Application No. PCT/US2019/036528, dated Sep. 23, 2019, 16 pages.

Official Action and Search Report dated May 14, 2019 in connection with Russian Patent Application No. 2017114513, 30 pages including English translation.

"3rd Party Observation for Application No. EP20150846788", dated Aug. 12, 2019, 10 pages.

International Search Authority, Federal Services on Intellectual Property, "Search Report for PCT/US2015/053449", "Foreign Counterpart to U.S. Appl. No. 15/109,503", dated 2019, pp. 1-2.

International Search Report and Written opinion received for International Application No. PCT/US2013/034625, 16 pages.

International Preliminary Report on Patentability received for International Application No. PCT/US2019/036528, dated Dec. 24, 2020, 10 pages.

* cited by examiner

NAIL LAMP

CROSS-REFERENCE TO RELATED APPLICATIONS

This application is a continuation of International Patent Application No. PCT/US2019/036528, filed Jun. 11, 2019, entitled "NAIL LAMP," which in turn claims priority U.S. Provisional Patent Application No. 62/683,067, filed Jun. 11, 2018; U.S. Provisional Patent Application No. 62/686,168, filed Jun. 18, 2018 and U.S. Provisional Patent Application No. 62/744,271, filed Oct. 11, 2018, each of which are incorporated by reference herein, in the entirety and for all purposes.

TECHNICAL FIELD

The present disclosure is related to a light-curing nail lamp, having a light source designed to cure a light-curable nail coating product on a user's nails.

BACKGROUND

A nail coating may be classified into two categories: nail polish (e.g., lacquers, varnish or enamels), and artificial nails (e.g., gels or acrylics). Nail polish typically comprises various solid components, which are dissolved and/or suspended in non-reactive solvents.

Artificial nails are comprised of chemically reactive monomers, and/or oligomers, and photo initiators in combination with non-reactive polymers to create systems that are typically 100% solids and do not require non-reactive solvents. The photo initiators react with light to form radical photo initiators, which in turn, react with the ingredients listed above to form a nail coating. An artificial nail is known to exhibit improved durability and wear properties relative to conventional nail polish.

A problem existing with current nail lamps is a non-uniform curing of the user's nails. This is particularly true for the thumb nails of the user. The rail lamp disclosed herein solves the existing problem.

SUMMARY

This application is directed to nail lamps with improved means of achieving uniform curing of artificial nails. These means include an angled surface e.g. wall which reflects light from the perimeter of the nail treatment space, towards the center of the nail treatment space. The angled surface may increase the amount of light impacting the thumb nail relative to other nails and the overall amount of light impacting all nails in a given lamp and at an overall power level. This application is also directed to use of reflectors that are associated with each light source and integrated with the overall lamp structure to increase the amount of light impacting all nails in a given lamp and at an overall power level.

The light-curing nail lamps of the present disclosure are intended to cure nail polish and, artificial nails. Ultraviolet radiation with a wavelength range of 365 to 425 nm is used to cure some artificial nails. Ultraviolet light sources with wavelengths as low as 100 nm can also be used. Visible light with wavelength of 425 nm or higher can also be used. The choice of wavelength or wavelengths to cure an artificial nail or nail polish will be depend on the photo initiators, the colors of the pigments and other aspects of the nail polish or artificial nail.

In an embodiment of this disclosure, a nail lamp will include one or more light sources, a housing, a nail treatment space located below the light source sized to allow insertion of at least one nail of a user, a vertical axis, a base plane and an angled surface located at the perimeter of the nail treatment space and oriented upward, towards the housing, and into the center of the nail treatment space.

In an embodiment of this disclosure, a first angled surface is located at one of the left boundary or the right boundary of the nail treatment space and a second angled surface is located at the other of the left boundary and the right boundary of the nail treatment space.

In an embodiment of this disclosure, the first angled surface is oriented at an angle of between 110 degrees and 160 degrees relative to the base plane.

In an embodiment of this disclosure, the first angled surface is oriented at an angle between 130 and 140 degrees relative to the base plane.

In an embodiment of this disclosure, the first angled surface is oriented at an angle between about 110 and 130 degrees relative to the base plane as measured in a plane parallel to the front of the lamp.

In an embodiment of this disclosure, the first angled surface is oriented at an angle between about 165 and 175 degrees relative to the base plane in a plane parallel to the side of the nail lamp.

In an embodiment of this disclosure, the angled surface is oriented at an angle of about 0 and 15 degrees relative to the side of the lamp.

In an embodiment of this disclosure, the angled surface extends around the left side, the right side and the rear of the nail treatment space.

In an embodiment of this disclosure, the nail lamp includes a platform surface located below the nail treatment space and a thumb marking (100) on the platform surface intended for placement of a thumb.

In an embodiment of this disclosure, the angled surface is less than 4 centimeters from the thumb placement.

In an embodiment of this disclosure, at least a portion of the angled surface is below the thumb marking.

In an embodiment of this disclosure, the angled surface is adjacent to the nail treatment platform surface.

In an embodiment of this disclosure, the nail lamp (1) includes two or more light sources (5), a housing (20); a nail treatment space (30) located below the housing, said nail treatment space sized to allow insertion of at least one nail of a user, a support surface above the nail treatment space and below the housing, and each light source is adjacent to a reflector the reflectors are integral with the support surface.

In an embodiment of this disclosure, the lamp accommodates an at least one user nail, and the at least one user nail may be found on the user's hand or foot.

DETAILED DESCRIPTION

The terms used in this specification generally have their ordinary meanings in the art, within the context of the disclosure, and in the specific context where each term is used. Certain terms are discussed below, or elsewhere in the specification, to provide additional guidance to the practitioner in describing the product designs, compounds, compositions, and methods of the disclosure and how to make and use them. Moreover, it will be appreciated that the same thing can be said in more than one way. Consequently, alternative language and synonyms may be used for any one or more of the terms discussed herein, nor is any special significance to be placed upon whether or not a term is elaborated or discussed herein. The use of examples anywhere in this specification, including examples of any terms discussed herein, is illustrative only, and in no way limits the scope and meaning of the disclosure or of any exemplified term. Likewise, the disclosure is not limited to the examples presented.

Figure 1:
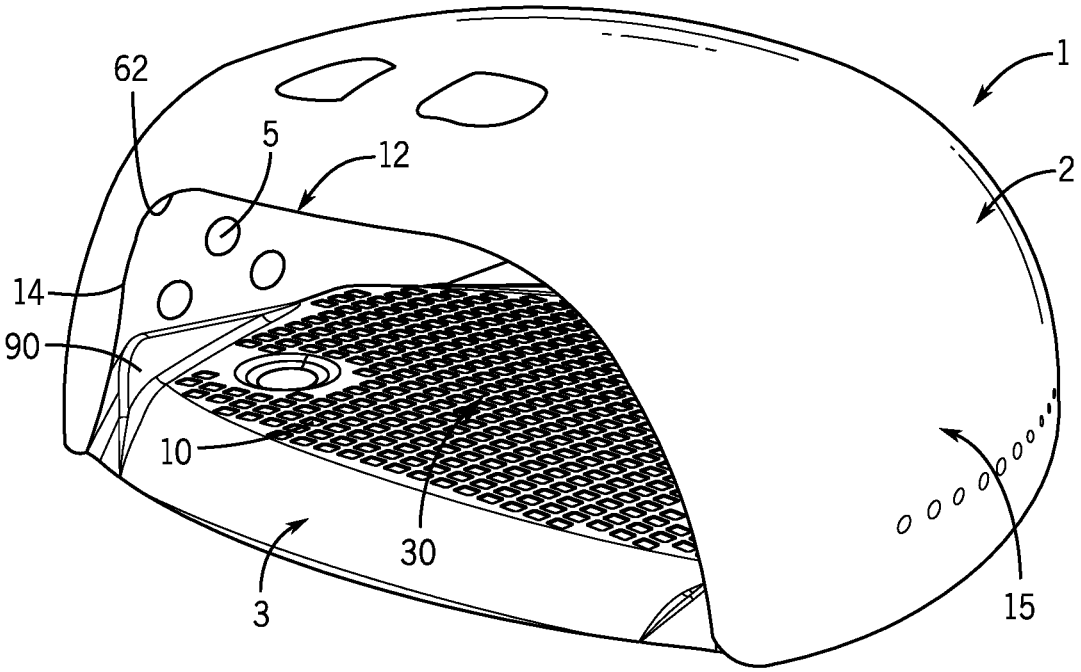
FIG. 1 is a front perspective view of a nail lamp according to an embodiment of the present disclosure.
Figure 2:
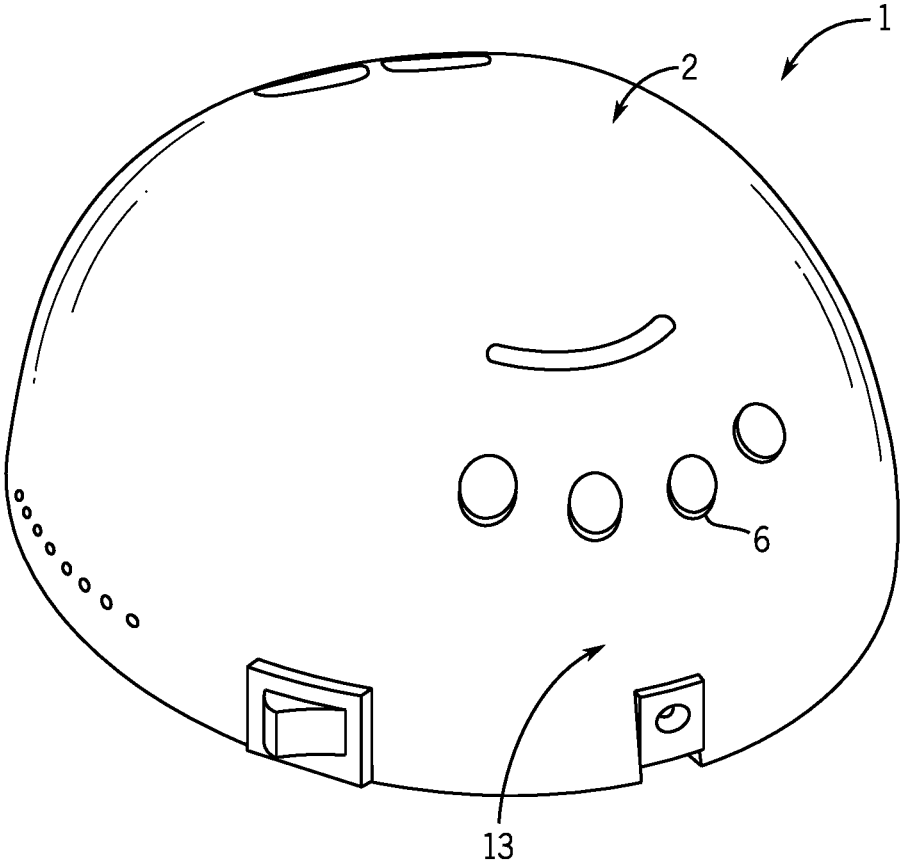
FIG. 2 is a rear perspective view of a nail lamp according to an embodiment of the present disclosure.

FIGS. 1 and 2 illustrate a nail lamp 1 according to an embodiment of the present disclosure. The lamp 1 includes, a housing 2 mounted to a base 3, one or more light sources 5 (FIG. 3) supported by the housing 2, and a controller 6.

The housing 2 and the base define an open volume or compartment for receiving the nails and optionally the fingers, toes, hands and feet being treated i.e. a nail treatment space 30. At least one user nail on the hand or foot are inserted in the nail treatment space for treatment. The illustrated base 3, housing 2 and nail treatment space 30 may be sized to accommodate all five nails of a user's appendage. The base 3, housing 2 and the nail treatment space 30 may alternatively be sized to simultaneously accommodate a greater or fewer numbers of nails. For example, the platform and nail treatment space may be sized to simultaneously accommodate the user's four nails; sized to accommodate one nail at a time; or sized to simultaneously accommodate both of the user's hands or feet so as to accommodate all ten of the user's finger or toe nails (for example, the nail lamp discussed below). The nail treatment space is configured to accommodate one or more digits. The configuration of the lamp disclosed herein may have an accommodation for the thumb to ensure the thumb nail cures evenly with the rest of the nails on the hand when inserted on the base. The design of the lamp disclosed herein may also have an accommodation to ensure the outer edges of all nails also cure evenly with the rest of the nail surfaces.

As used herein, the first side 12 of the lamp 1 refers to the side a user's digits extend into during use (the opening shown in FIG. 1). Conversely, a second side 13 of the lamp 1 is an opposite side to the front (shown in FIG. 2). The second side of the lamp may have a closed configuration as in FIG. 2 or may be fully or partially open. The left side of the lamp 14 extends on the left side of the opening in FIG. 1, and the right side of the lamp 15 extends on the right side of the opening in FIG. 1. The top portion of the lamp 1 extends upwardly in FIG. 1 and the bottom portion of the lamp conversely extends downwardly in FIG. 1.

Figure 3:
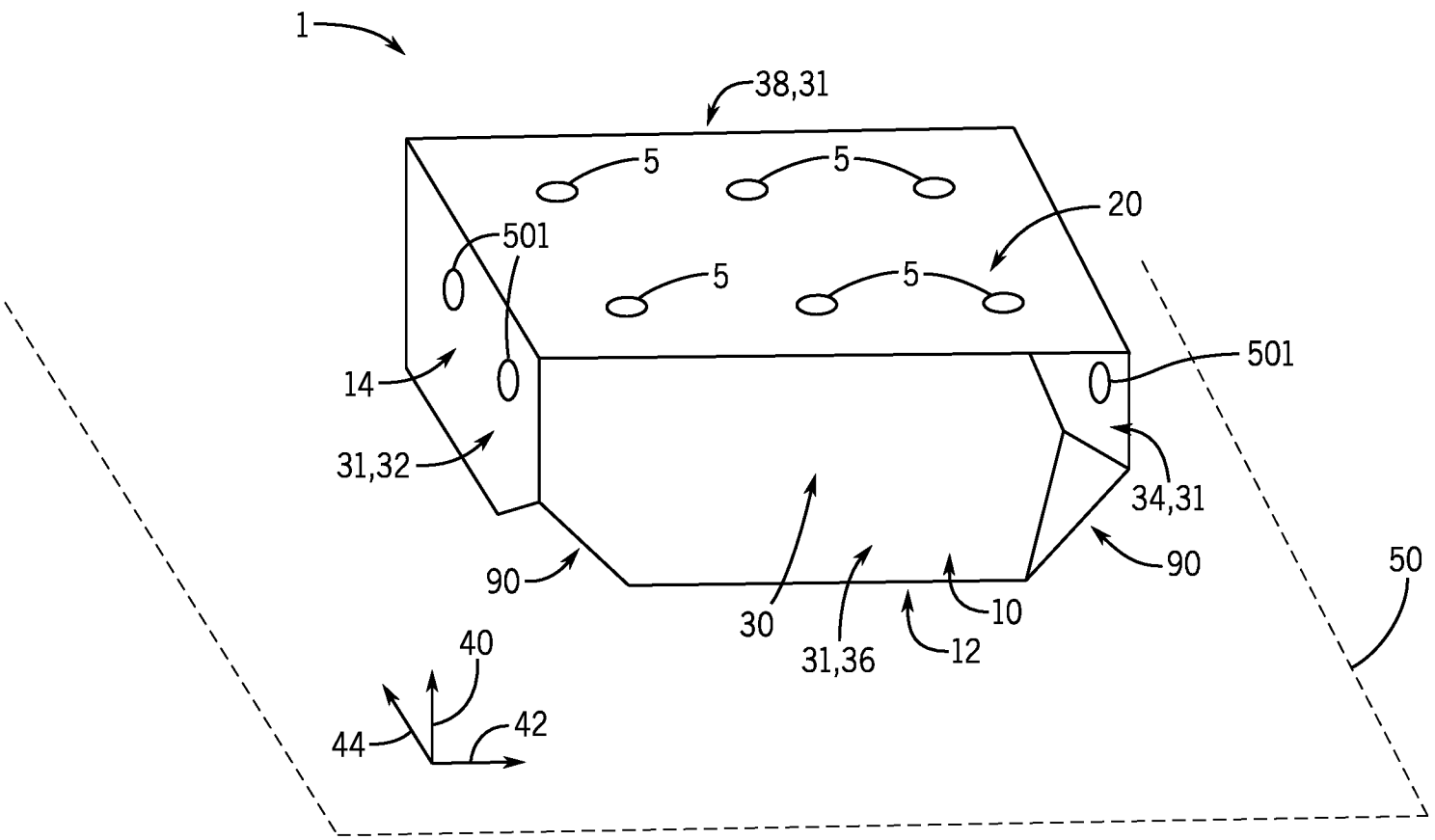
FIG. 3 is a view of a platform surface, a support surface, a space, light sources and angled walls of an embodiment of the present disclosure.

FIG. 3 is a schematic of the lamp with parts of the housing 2 and the base 3 removed in order to provide a detailed view of the nail treatment space 30. The nail treatment space 30 includes an upper boundary defined by the support surface 20 and a lower boundary defined by the platform surface 10. The platform surface 10 and the support surface 20 may be separable or integral with the housing 2 and the base 3. The nail treatment space also has an outer boundary 31 which includes a front boundary 36, a rear boundary 38, a left boundary 32 and a right boundary 34, each aligned respectively to the first side 12, second side 13, left side 14 and right side 15 of the lamp 1. The nail treatment space 30 is also bounded by an angled surface 90.

Associated with the lamp are a vertical axis 40 with a positive direction defined by the distance between the nail treatment space 30 and the housing 2, a first horizontal axis 42, perpendicular to the vertical axis and with positive direction defined by the distance from the left size of the lamp to the right side of the lamp 15 and a second horizontal axis 44, perpendicular to the vertical axis 40 and the first horizontal axis 42. The second horizontal axis 44 may have a positive direction defined by the distance from the front to the rear of the lamp. The intersection of the first horizontal axis and the second horizontal axis define a base plane 50. In embodiments of the present disclosure, the base plane and the first and second horizontal axes may be parallel to a surface that the lamp is intended to rest on.

Note that the shapes of the nail treatment space 30 and the lamp within the scope of this disclosure are not limited by the above specification of sides. The shape of the lamp and the nail treatment space may be but is not limited to square, rectangular polygonal, oval, round or any other shape. The description of sides and boundaries may be applicable to all shapes without limit. For example, a round space may have first, second, left and right designed by four even or uneven sections of the perimeter. The shape of the nail treatment space may be configured to fit a human hand wherein the distance between the first side and the second side is greater near the centerline of the lamp and near the left side or right side of the lamp. Furthermore the dimensions of the nail treatment space in the vertical direction may be less than the dimensions between the first and second sides or the left and right sides.

The nail treatment space 30 will have upper and lower boundaries defined by surfaces. These surfaces may be referred to as a support surface 20 and a platform surface 10 and are discussed in more detail below. The lower boundary of the nail treatment space 30 may be defined by the surface that the lamp rests on.

As shown in FIG. 3, nail lamp 1 includes a plurality of light sources 5. As used herein, "light source" is defined broadly to include any light source or light-generating mechanism. The nail lamp may include only a single light source or a plurality of light sources with the maximum number of sources only limited by available surfaces in the lamp. As seen in FIG. 3 the light sources 5 are typically mounted at the support surface 20 and are directed into the nail treatment space 30. Light sources 501 may also be located at the sides of the nail treatment space 30. Light sources may also be mounted on the platform surface, with light traveling towards the support surface and reflecting into the nail treatment space 30. Each of the top light sources 5, 501 may be of any suitable construction and configuration, and may vary across embodiments. For example, in various embodiments the light sources 5, 501 can be UV light bulbs, fluorescent light bulbs, infrared light bulbs, or candescent light bulbs. In an embodiment, the light sources 5, 501 may have a shape of a tube or of a combination of tubes. In some embodiments, the light sources 5, 501 may include Light Emitting Diodes (LEDs). In an embodiment, the light sources 5 may comprise an array of sources (including but not limited to an array of LEDs) which may generally be disposed to have a shape (e.g., physically or in terms of light output) of the nails on a hand or foot; or a semicircular shape formed by a region connecting all of the nails on a hand or a foot. In an embodiment, the light bulbs 5, 501 may be elongated and may have a length of between about 50 mm about 150 mm. In one such embodiment, the length of each of the top light bulbs 5 and the side light bulbs 501 may be between approximately 125 mm and 130 mm. In an embodiment, the light sources 5 may be configured to emit a wavelength of light configured to photo chemically cure gel or acrylic applied to the finger or toe nails of the hands or feet placed in the nail treatment space 30.

The light sources 5, 501 may be chosen to supply light in the UV light range or outside of the UV light range depending of the cure characteristics of the artificial nails being applied. An embodiment of the current disclosure may incorporate multiple wavelengths of UV radiation to optimize both surface and through the thickness curing of an artificial nail as disclosed in US20160370113A1 (incorporated by reference).

Embodiments of this disclosure may also include a controller which serves to supply power to the light sources. Depending on user input the controller may be programmed to apply power to all light sources only select light sources. Also the controller may control the amount of time light sources are turned on and whether radiation is supplied at all available wavelengths or if only select wavelengths of radiation are delivered. There variations are discussed in US20160370113A1 and incorporated by reference in this disclosure.

A controller circuit board and wiring may be placed between the housing 2 and the support surface 20.

An embodiment of the present disclosure may include a platform surface 10 and/or a support surface 20 as shown in FIG. 3. The platform surface 10 may be integral with the base or separate and removable from the base 3. The platform surface 10 may be configured to receive and hold the appendages and nails of the user to rest on e.g. the platform surface 10 may be a resting surface during treatment. The support surface 20 may be integral with or separate and removable from the housing 2. The support surface may anchor or be configured to anchor an array of light sources either in combination with the housing or independent of the housing.

The platform surface and the support surface may also be separable from the base and the housing. The platform surface 10 may form the lower boundary of the nail treatment space 30 and may be configured for the users' digits and appendages to rest on. The support surface 20 may define the upper boundary of the nail treatment space 30. An embodiment of the disclosure may function with only a support surface and a light source. In this embodiment a user's appendages and nails may be placed in a nail treatment space below the surface. The support surface and optionally the housing may rest on a table or other suitable external surface.

Figure 4:
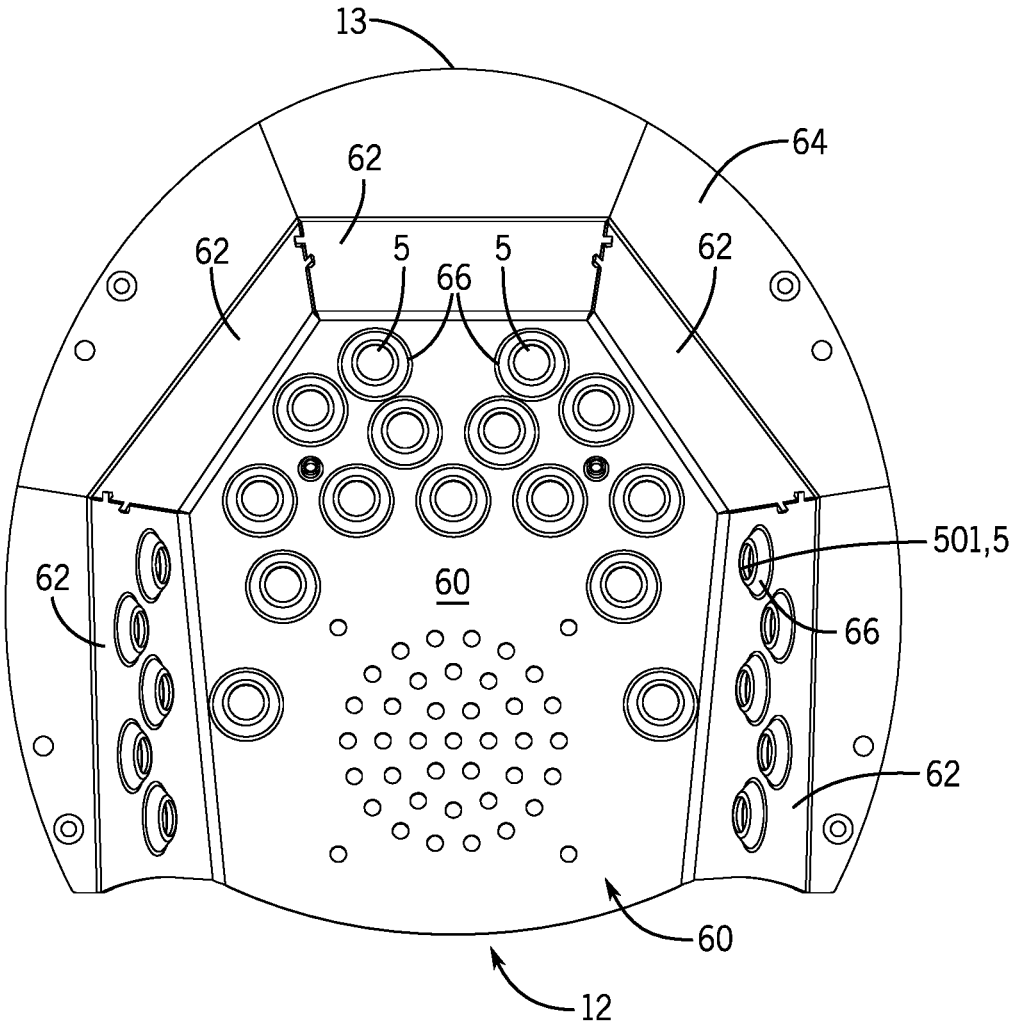
FIG. 4 is a bottom view of a support surface, light sources and reflectors of an embodiment of the present disclosure.

An embodiment of the support surface is shown on FIG. 4. The view in FIG. 4 is from below. The embodiment of FIG. 4 includes a central section 60, side sections 62, an outer flange 64 for attachment to the platform surface and a set of reflectors 66 for placement of light sources 5. In FIG. 4 the central 60 and side 62 sections of the support surface are relatively planar and at an angle relative to one another. Further, as shown on FIG. 1, the side section of the support surface 62 intersects the platform surface 10 at an acute angle. In other embodiments, the support surface may form a continuous rounded dome, eliminating one or more of the corners seen in FIG. 3. The side surfaces may also form a non-acute angle with the base and the platform surface. In other embodiments, one or more side sections 62 may be eliminated so that the nail treatment space 30 is open to the surrounding environment at the rear or the sides of the lamp.

In an embodiment of this disclosure the support surface may have a reflective surface facing the nail treatment space. Furthermore, all surfaces bordering the nail treatment space can have a reflective surface to maximize the amount of light potentially reflecting off a surface and impacting a nail. The reflective property may be produced by any number of means known in the art. The support surface may be made of a polished or non-polished metal surface such as stainless steel, carbon steel or aluminum. The metal may be stamped or machined to the desired shape. The support surface may also be made of a polymer. A polymer with or white colorant or relatively light color polymer with or without added color fillers may be adequate. Alternatively the polymer surface may be made reflective by any number of means including adhesively attached reflective stickers or metallization. The support surface may also be made of a clear glass or a clear polymer such as Surlyn with a metallized back surface to produce a mirror like effect.

The housing may have a number of purposes including but not limited to lending structural support to the light sources, the controllers and other elements of the lamp, defining the nail treatment space, supporting the support surface, acting as a handle for portability and preventing UV light from exiting the nail treatment space. The housing of FIG. 1 encloses the nail treatment space on all sides except the first side 12. Other housings according to the present disclosure may enclose less of the nail treatment space.

The support surface embodiment of FIG. 4 includes a series of reflectors 66 and light sources 5. Reflectors and light sources may be distributed throughout the support surface. The arrangement of the light sources may be optimized to give a uniform distribution of light on all varieties of nail surfaces expected to be placed in the lamp. For example the reflectors and light sources may be arranged in a semi-circular pattern as in FIG. 4 to match the pattern of nails on a typical user's hand. In some embodiments of the present disclosure, the light sources and reflectors ability to give uniform light distributions on all nail surfaces is augmented by reflective surfaces of the support surface and the platform surface.

In the embodiment of FIG. 4, the reflectors 66 are integral with the remainder of the support surface. The integrated reflector and support surface can be produced by any number or processes known in the art including but not limited to stamping a single sheet of metal, thermoforming of a polymer or injection molding of a polymer. Alternatively the reflectors 66 may be separate parts from the balance of the support surface with attachment by any number of means including but not limited to screwed connection, snap fit, and adhesive.

Figure 5:
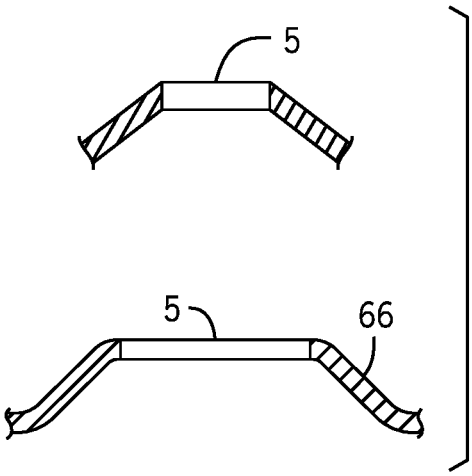
FIG. 5 contains cross section view of conical reflectors.
Figure 6:
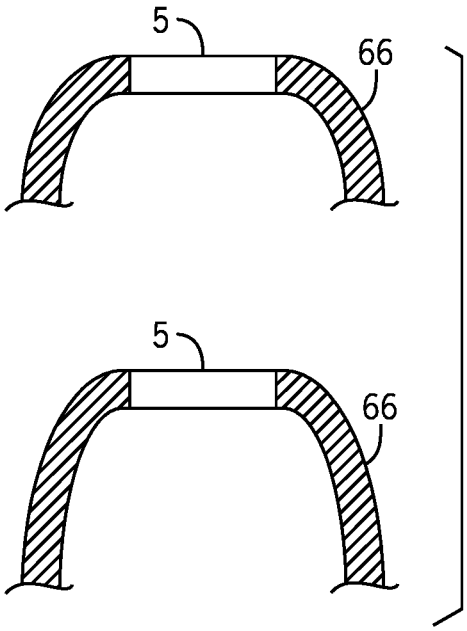
FIG. 6 contains cross section view of parabolic reflectors.

The reflectors of FIG. 4 have a partially conical shape as shown in FIG. 5. The conical shape includes a region of constant slope in the cross section of the reflector. Alternatively the reflectors may take a parabolic shape as in FIG. 6 where the curvature is continuously variable in the cross section. The choice of reflector shape will affect the distribution and uniformity of light in the nail treatment space. Each light source 5 may be surrounded by a reflector. As depicted in FIGS. 4, 5 and 6, each light source may adjacent to a reflector. In the case of round or oval reflectors as in FIGS. 4, 5 and 6, the light sources may be surrounded by the reflectors.

The optional platform surface 10 may be designed with the intention of the users appendages resting on the platform surface. The platform surface 10 of FIG. 7 includes markings 100 or depressions 100 to guide left or right thumb placement. Additional markings may be used to guide placement of additional digits and for the left hand, right hand, left foot or right foot. The platform surface may have a flat topology or some amount of curvature. Curvature may be used for the purposes of keeping the users hand comfortable during treatment and to help insure all nails are equidistant from light sources and/or reflective surfaces. The designer of the lamp will consider the shape of the platform surface 10 in coordination with the design and layout of the light sources 5, the support surface 20, the housing 2 and various reflective surfaces. The platform surface of FIG. 7 has the thumb markings at a higher position along the z axis the region than the surrounding region.

In an embodiment of this disclosure the platform surface may have a reflective surface facing the nail treatment space. The reflective property may be produced by any number of means known in the art. The platform surface may be made of a polished or non-polished metal surface such as stainless steel, carbon steel or aluminum. The metal may be stamped or machined to the desired shape. The platform surface may also be made of a polymer. A polymer with or white colorant or relatively light color without filler may be adequate. Alternatively the polymer surface may be made reflective by any number of means including adhesively attached reflective stickers or metallization. The platform surface may also be made of a clear glass or a clear polymer such as Surlyn with a metallized back surface to produce a mirror like effect. Furthermore the platform surface may include a texture such as that shown in FIG. 7 to aid dispersion of light throughout the lamp and uniformly over the nail. Any number of patterns can be used in place of that in FIG. 7 as known in the art to aid light distribution.

Figure 7:
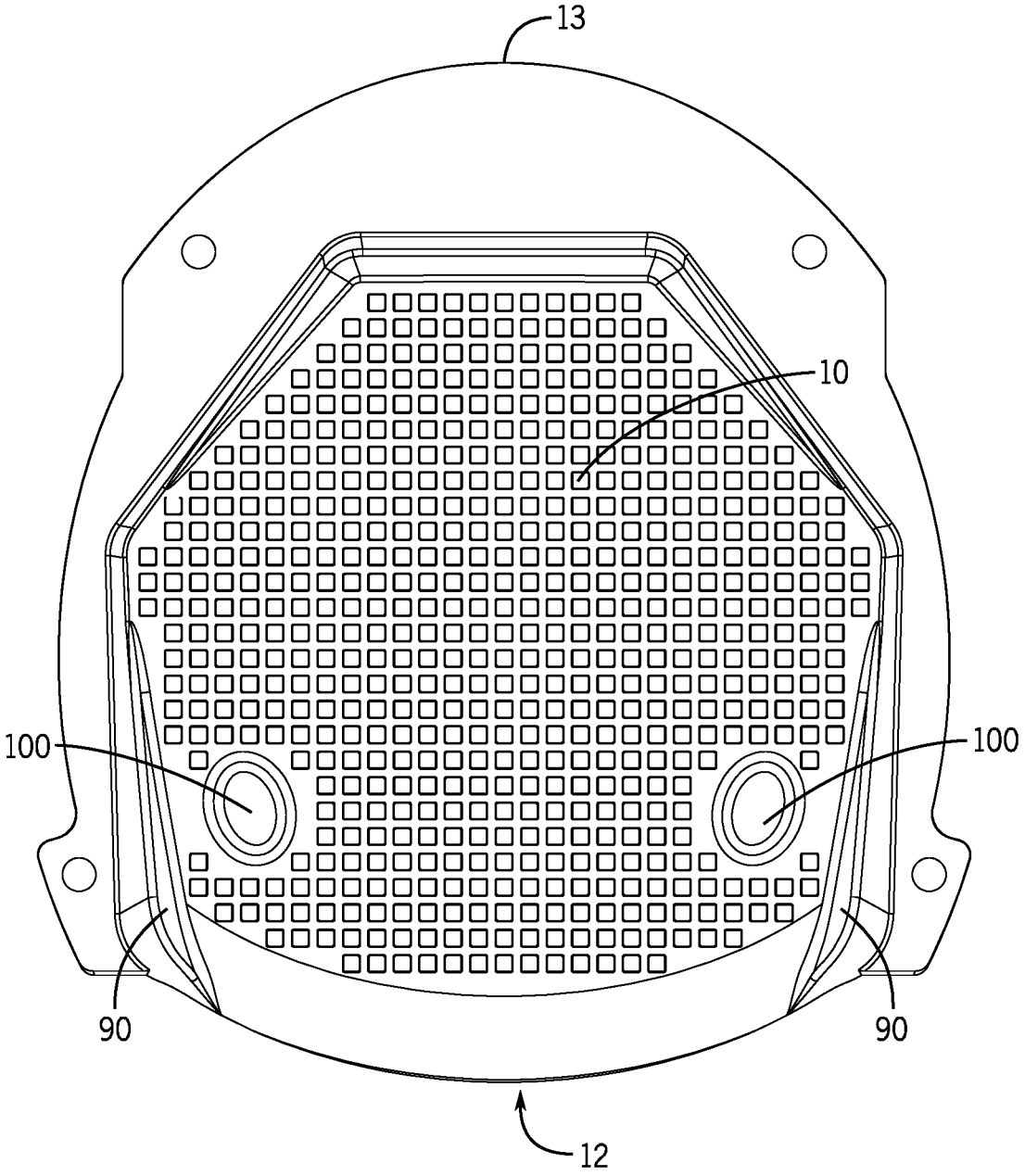
FIG. 7 is a top view of a platform surface, a base and an angled wall of an embodiment of the present disclosure.

The angled surface 90 is positioned at the perimeter of the outer boundary 31 of the nail treatment space 30. The angled surface 90 may be positioned at an opening of the lamp 1 defined by the nail treatment region 30 and may taper as it extends into the nail treatment region 30. This may result in a portion of the opening defined by the nail treatment region 30 having a width that is smaller than a width of an interior of the nail treatment region 30. According, the angled surface may comprise a cross-section that becomes smaller as the angled surface 90 extends into the interior of the nail treatment region 30. In the embodiment of FIGS. 1, 3 and 7 an angled surface 90 is positioned at both the left side boundary 32 and the right side boundary 34 of the nail treatment space 30. Embodiments of the current disclosure may also include an angled surface at the rear boundary 38. Rather than having separate sections of an angled surface in portions of the outer boundary of the nail treatment space 30, a single, continuous angled surface may extend along the left side boundary, the right side boundary and the rear boundary of the nail treatment space 30. The angled surface may also extend along the front boundary of the nail treatment space 30.

In the embodiment of FIGS. 1, 3 and 7, the angled surface 90 is integral with the platform surface 10. Embodiments of this disclosure need not have the angled surface 90 integral with the platform surface 10. The angled surface 90 may also be integral with the support surface 20, the base, or the housing or independent. The angled surface 90 may also adjacent to the platform surface 10 but may be a separate part i.e. not integral with the platform surface 10.

Figure 8:
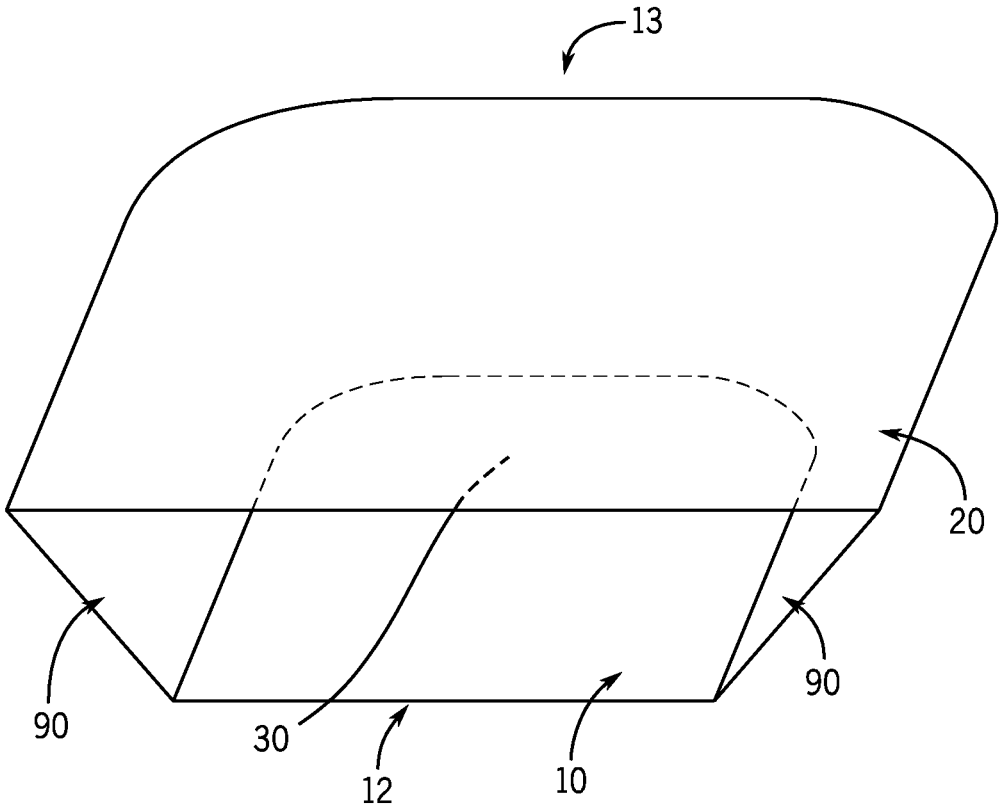
FIG. 8 is a perspective view of a platform surface, a support surface, a space and angled walls of an embodiment of the present disclosure.

In the embodiment of FIGS. 1, 3 and 7, the angled surface 90 spans only a fraction of the distance from the platform surface 10 to the support surface 20. In alternate embodiments, the angled surface 90 may span the entire distance from the platform surface 10 to the support surface 20. FIG. 8 depicts an embodiment of this disclosure where the angled surface 90 spans the entire distance between the platform surface 10 and the support surface 20. The angled surface 90 of FIG. 8 also traverses the left, right and rear boundary surfaces of the nail treatment space 30.

Figure 9:
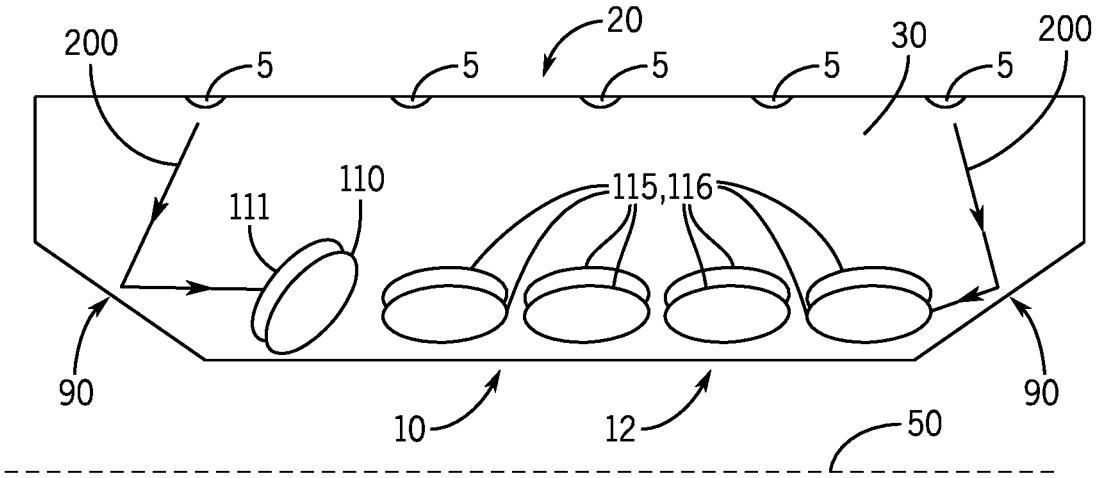
FIG. 9 is a rear view of a platform surface, a support surface, a space, a set of light sources, a set of fingers and angled walls of an embodiment of the present disclosure.

A purpose of the angled surface 90 or walls is to maximize the amount of light emitted from the light sources that will impinge on the target nail surface. Furthermore the angled surface may improve the uniformity of light impinging all nail surfaces 110, 116. This includes both the end surfaces of the nails and the thumb. FIG. 9 depicts a thumb 110, a thumb nail 111 and four additional fingers 115 and four additional finger nails 116. Light from the support surface 20 may not directly impinge the entire outer surface of the thumb nail 111. The intensity of light impinging portions of the thumb nail may not be as great as the intensity of light impinging other portions of the thumb nail and the other finger nails. As depicted in FIG. 9, reflected light from the angled surface 90, will more likely impact all parts of the thumb nail and impinge the thumb nail at a higher intensity.

In an embodiment of this disclosure the angled surface 90 may be at the same vertical position as the thumb and any/or all fingers that are intended to be treated during use. Alternatively, any part or all of the entire angled surface 90 may be at a lower vertical position than the thumb and/or all fingers that are intended to be treated during use. In this way, light can be reflected upward towards the sideways facing thumb of FIG. 9 or the side and lower facing surface of other nails.

The use of the phrase angled surface in this disclosure refers to surfaces with a particular range of orientations relative to the nail treatment space 30. The angled surface 90 is oriented in the positive direction of the vertical axis and is oriented in a horizontal direction towards the nail treatment space 30. As depicted in FIG. 9, light 200 coming down from the support surface 20 and the light source 5 can reflect directly onto the outer surface of the thumb nail, equilibrating the amount of light impinging this region with the amount of light impinging other nails. The presence of the angled surface 90 may also improve the distribution of light on other portions of the nails including the distal edges.

Figure 10:
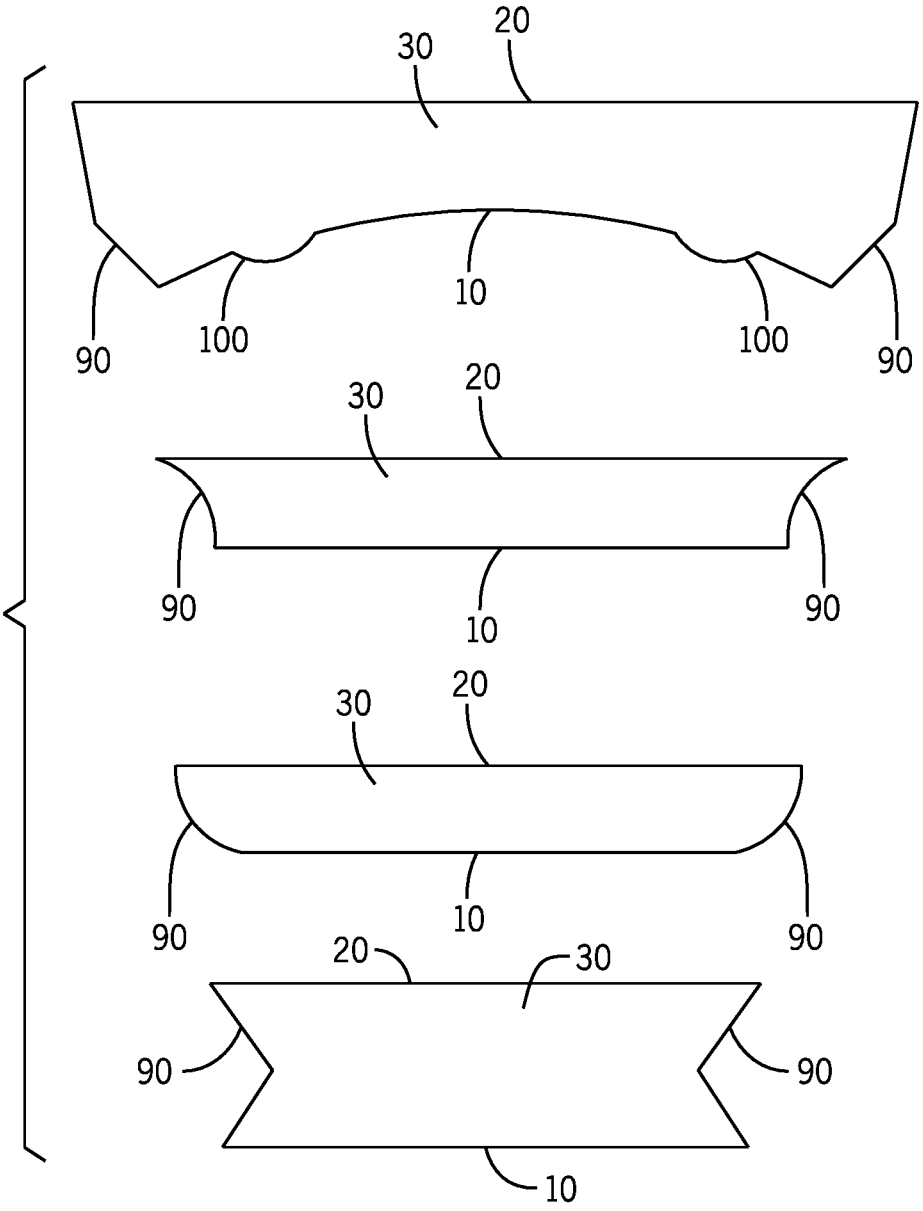
FIG. 10 is of side views of a series of platform surfaces, support surfaces, and angled walls of the present disclosure.
Figure 11:
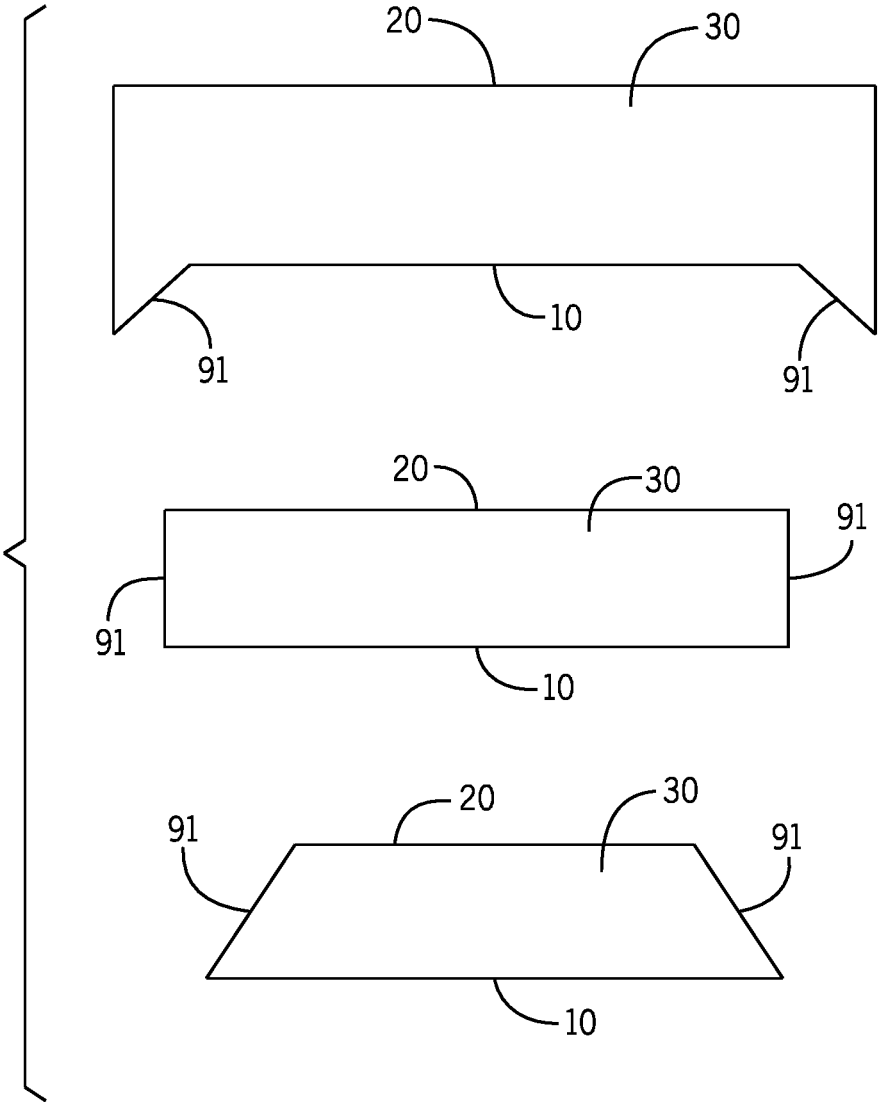
FIG. 11 is of side views of a series of platform surfaces, support surfaces, and walls outside the scope of this disclosure.

The embodiment of the angled surface in FIGS. 3, 7 and 9 is a planar wall. The angled surface may also be convex, concave, or any type of irregular shape so long as at least sections of the angled surface are oriented in the positive direction of the vertical axis and are oriented in a horizontal direction towards the nail treatment space. FIG. 10 includes examples of angled surfaces 90 that are oriented in the positive direction of the vertical axis and are oriented in a horizontal direction towards the nail treatment space. FIG. 11 includes examples of surfaces 91 that are not oriented in the positive direction of the vertical axis or are not oriented towards the nail treatment space 30. Embodiments that fall within the scope of this disclosure include but are not limited to the examples in the Figures and specification of this disclosure.

Figure 12:
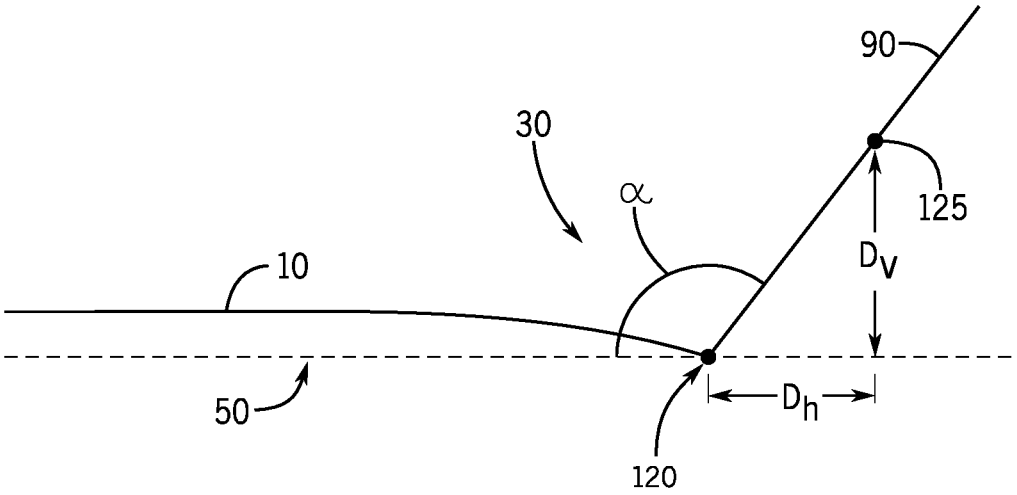
FIG. 12 is a schematic description of a means to measure and calculate the angle between the base plane and an angled wall.

The angled surface may be characterized by the angle between the angled surface and the base plane 50 that transverses the nail treatment nail treatment space 30. The angle of the angled surface 90 relative to the base plane 50 can be measured as depicted in FIG. 12. A point 120 is selected at or in the vicinity of the lower edge of the angled surface. A second point 125 on the angled surface is chosen remote from the first point. The first and second points may be chosen to traverse a direction of maximum slope along the wall. The specific points used may be chosen at the discretion of one executing the measurement. If any pair of points chosen satisfies the requirements of a given claim, the requirements of the given claim are considered met. The distance from the first point 120 to the second point 125 is measured in horizontal direction and recorded as $D_h$. If the second point is further than the first point from the center of the platform, this distance has a positive value. If the second point is closer to the center of the platform surface than the first point, this distance has a negative value. The distance from the first point to the second point is also measured in the vertical direction, $D_v$. The angle of the angled surface relative to the base plane equal to:

$$\alpha=180-\text{arc tan}(D_v/D_h)$$

A range of $\alpha$ for the angled surface according to the current disclosure is between 100 and 170 degrees relative to the base plane. A more preferred range of $\alpha$ is between 120 and 150 degrees relative to the base plane. A most preferred range of $\alpha$ is between 130 and 140 degrees relative to the base plane.

In addition to the absolute angle of the angled surface relative to the base plane, the orientation of the angled surface is also important. The angle of the angled surface 90 relative to the base plane 50 can be measured on a plane perpendicular to the second horizontal axis. The same first point 120 may be chosen or a different point 120 may be chosen at the lower edge of the angled surface. The second point 125 is chosen to have the same coordinate along the first horizontal axis as the first point. The specific points used may be chosen at the discretion of one executing the measurement. If any pair of points chosen satisfies the requirements of a given claim, the requirements of the given claim are considered met. The distance from the first point 120 to the second point 125 is measured in the horizontal direction and recorded as $D_{h2}$. If the second point is further from the center of the platform than the first point, $D_{h2}$ has a positive value. If the second point is closer to the center of the platform surface than the first point, $D_{h2}$ has a negative value. The distance from the first point to the second point is also measured in the vertical direction, $D_{v2}$. The angle of the angled surface relative to the base plane in a plane perpendicular to the second horizontal axis is then equal to:

$$\alpha_2=180-\text{arc tan}(D_{v2}/D_{h2})$$

The angle of the angled surface 90 relative to the base plane 50 can be measured on a plane perpendicular to the first horizontal axis. The same first point 120 may be chosen or a different point 120 may be chosen at the lower edge of the angled surface. The second point 125 is chosen to have the same coordinate along the second horizontal axis as the first point. The distance from the first point to the second point is measured in horizontal direction and recorded as $D_{h1}$. If the second point is further from the center of the platform, $D_{h1}$ has a positive value. If the second point is closer to the center of the platform surface than the first point, $D_{h1}$ has a negative value. The distance from the first point to the second point is also measured in the vertical direction, $D_{v1}$. The angle of the angled surface relative to the base plane in a plane perpendicular to the second horizontal axis is then equal to:

$$\alpha_1=180-\text{arc tan}(D_{v1}/D_{h1})$$

Figure 13:
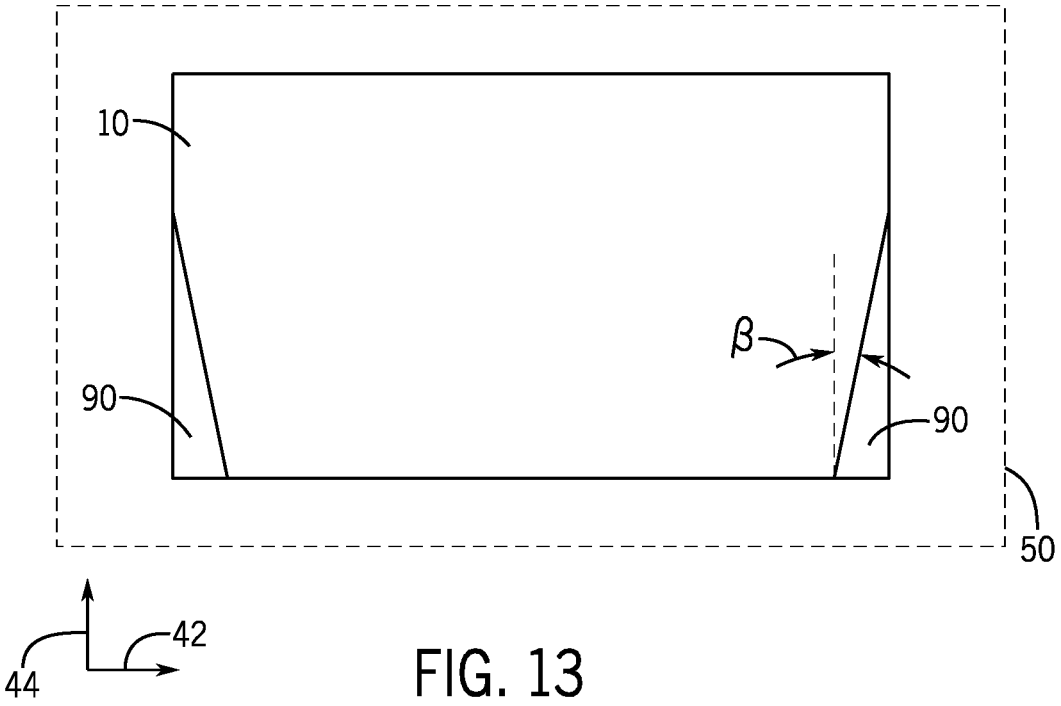
FIG. 13 is a top view of a platform surface and angled walls of the present disclosure.

As in FIGS. 7 and 13, the angled surface may be oriented at an angle of $\beta$ relative to the second horizontal axis. The angle $\theta$ may be calculated:

$$\beta=\text{arc tan}(\tan(180-\alpha_1)\tan(180-\alpha_2))$$

The above measurements and calculations of angles may be made by a range of reliable methods well known to those skilled in the art. A combination of an x-y tables, coordinate measuring systems, height gauges, simple protractors and non-contact systems such as those products by Mitutoyo Corp and Starrett Company may be used. Those skilled in the art may know of and use other reliable means.

Figure 14:
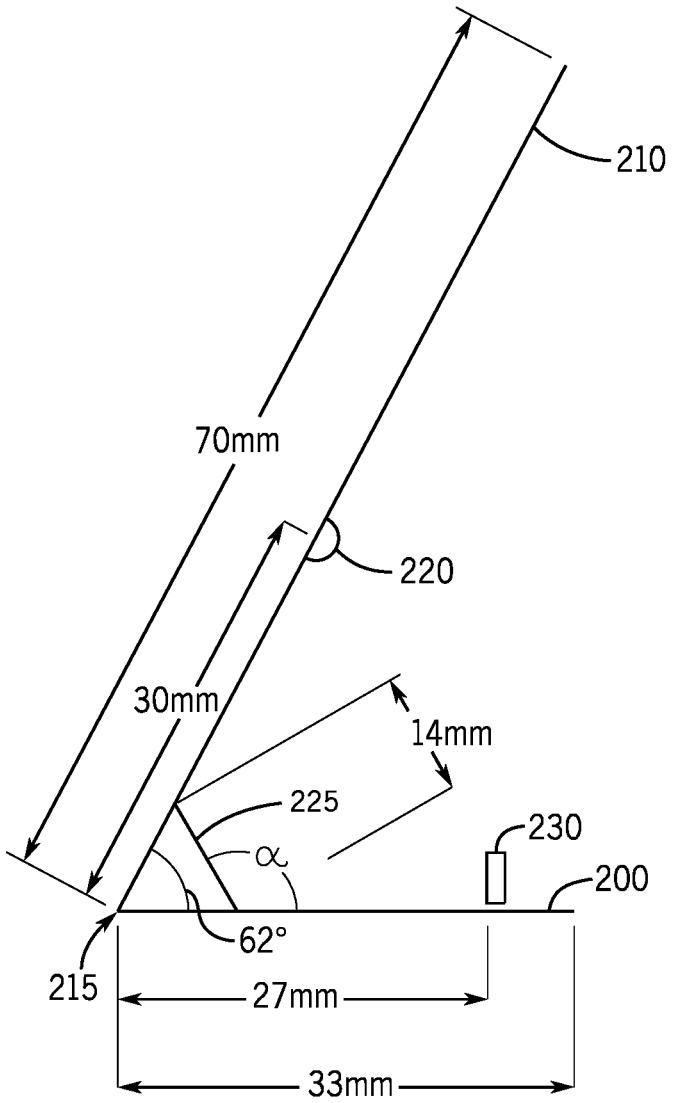
FIG. 14 is a drawing of a test fixture.

The test fixture depicted in FIG. 14 was used to demonstrate the angled surface. The fixture included a base wall 200, a side wall 210, an LED light source 220 mounted on the fixture and an angled surface 225. Note that the base wall and the side wall had reflective mirror like surfaces. An optical sensor 230 was placed on the base of the fixture with the sensing surface pointed to the left (towards the angled surface 225). The intention of facing the surface to the left was to simulate the light which would irradiate a sideward facing finger such as a typical thumb. The angled surface 225 was a mirror and was placed in the corner 215 with varying values of the angle $\alpha$ to quantify the effect of the angled on the light impinging a sideward facing nail. The angled surface 225 was 14 mm wide in the plane of FIG. 14 and 20 mm deep in the direction perpendicular to the page. FIG. 14 includes dimensions of the test fixture. The base wall and the side wall were about 13 cm wide (direction perpendicular to the page in FIG. 14).

The optical sensor was a model PD300-UV-ROHS sensor P/N 7Z02413 available from Ophir Co, of Jerusalem, Israel. The sensor was attached to a Nova handheld power meter Model 70260, available from ThermoOriel Instruments of Stratford, Conn.

Table 1 contains a summary of measured light intensity as a function of angle α.

TABLE 1

| LIGHT INTENSITY DETECTED AS A FUNCTION OF ANGLE α | |
|---|---|
| ANGLE α | LIGHT INTENSITY (MICROWATTS/CM$^2$) |
| NO ANGLED SURFACE | 70.3 |
| 90 DEGREES | 70.8 |
| 120 DEGREES | 77.8 |
| 135 DEGREES | 90.1 |
| 150 DEGREES | 79.4 |

A nail lamp was constructed with the platform surface of FIG. 7 and the support surface of FIG. 4. LED light sources were mounted on the support surface at the positions noted in FIG. 4. A PD300 light measuring gauge was placed on the platform surface directly over the center of the thumb spot 100. With the light sourced turned on, the light energy impinging the sensor was recorded. The measurement was made with the sensor facing upward, the sensor facing out of the nail treatment space 30, towards the angled surface 90 and with the sensor oriented at 45 degrees, upward and outward. The center of the sensor surface was always centered over the center of the thumb spot 100. A first set of the above measurements were made with the angled surface 90 not covered and able to reflect light towards the sensor. A second set of the above measurements were made with the angled surface 90 covered with black, non-reflective tape, to eliminate reflection to the sensor. Table 2 contains a summary of measured light intensity with and without the tape covering the angled surface 90.

TABLE 2

| LIGHT INTENSITY DETECTED WITH THE ANGLED WALL EXPOSED AND BLOCKED | | | |
|---|---|---|---|
| | LIGHT INTENSITY - SENSOR FACING OUTWARD (MICROWATTS/CM$^2$) | LIGHT INTENSITY - SENSOR AT 45 DEGREES (MICROWATTS/CM$^2$) | LIGHT INTENSITY - SENSOR FACING UPWARD (MICROWATTS/CM$^2$) |
| ANGLED WALL EXPOSED | 364 | 708 | 428 |
| ANGLED WALL BLOCKED | 352 | 700 | 382 |

Figure 15:
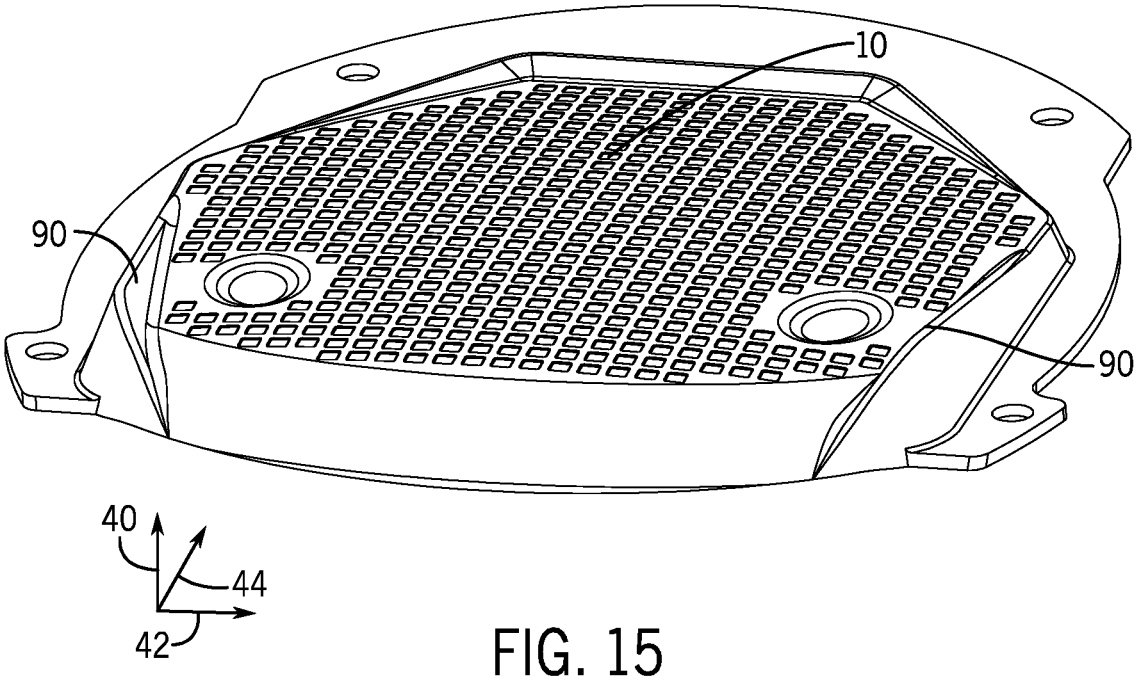
FIG. 15 is a view of a platform surface and two angled surfaces.
Figure 16:
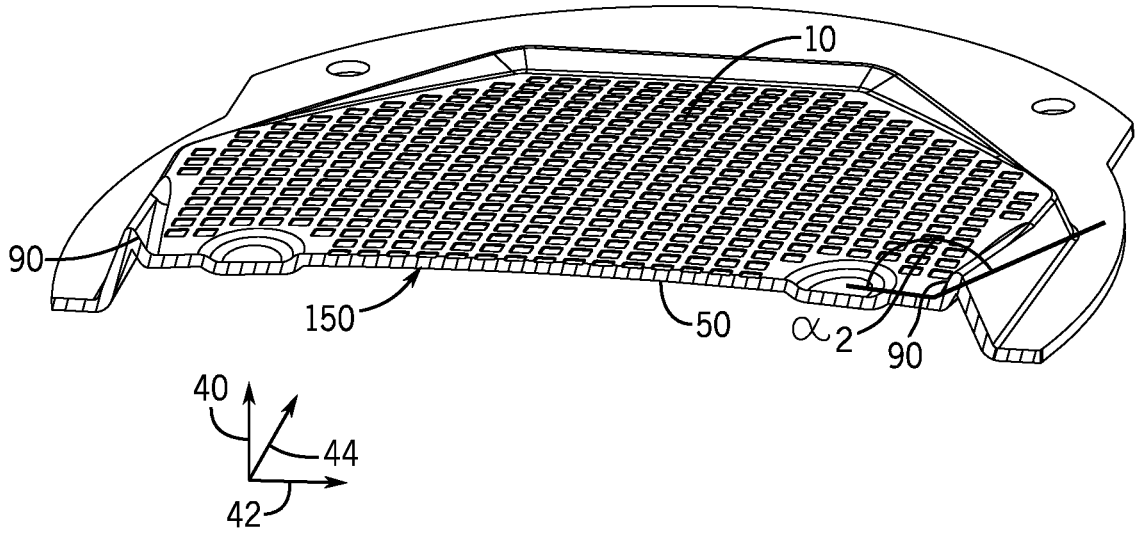
FIG. 16 is a view of a platform surface and two angled surfaces cross sectioned in a plane perpendicular to the second horizontal axis.

FIG. 15 is an image of a pair of angled surfaces 90 and a platform surface 10 according to one embodiment of this disclosure. FIG. 16 is an image of the pair of angled surfaces 90 and the platform surface 10 of FIG. 15 cross sectioned to reveal a plane 150 perpendicular to the second horizontal axis 44. The angle between the base plane 50 and the angled surface within the plane 150 is denoted by $\alpha_2$ and in FIG. 15 is equal to 120 degrees. In other embodiments of this disclosure, the angle $\alpha_2$ may be in the range of 100 to 160 degrees. The angle $\alpha_2$ may preferably be in a range from 110 to 149 or most preferably be in a range from 110 to 130.

Figure 17:
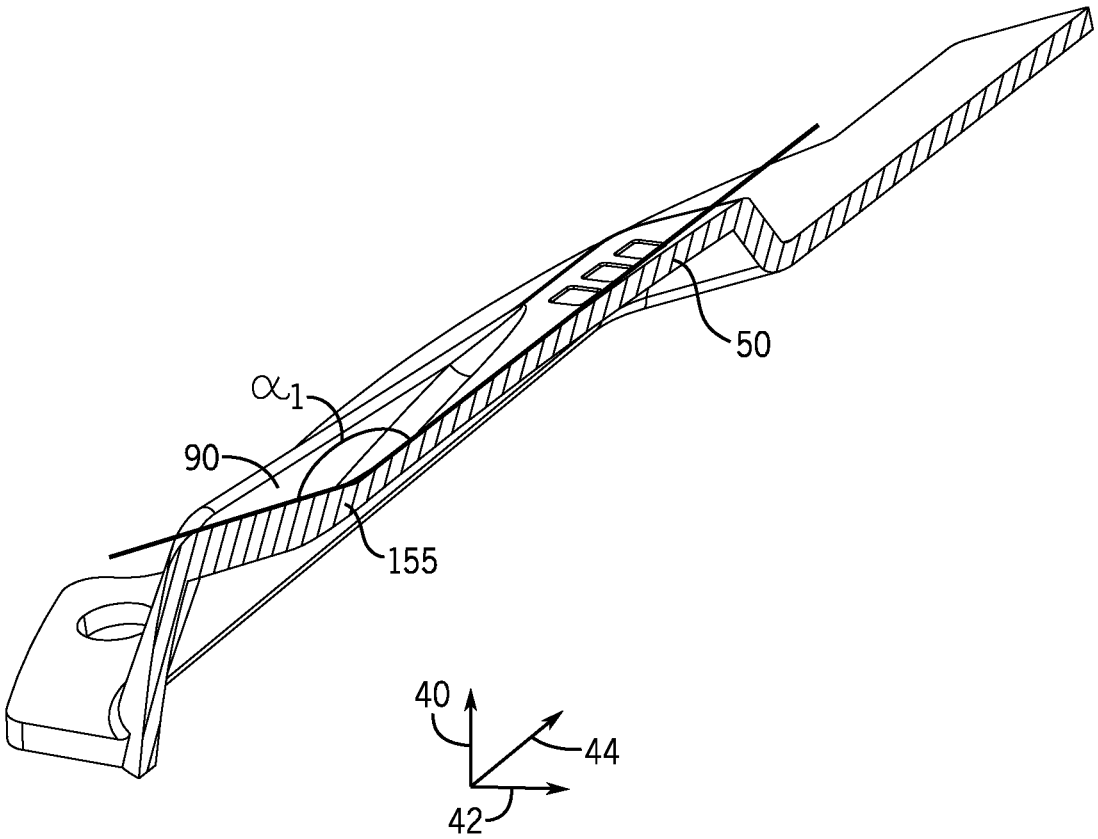
FIG. 17 is a view of a platform surface and two angled surfaces cross sectioned in a plane perpendicular to the first horizontal axis.

FIG. 17 is an image of the angled surface 90 and the platform surface 10 of FIG. 15 cross sectioned to reveal a plane 155 perpendicular to the first horizontal axis 42. The angle between the base plane 50 and the angled surface within the plane 155 is denoted by al and in FIG. 17 is equal to 172 degrees. In other embodiments of this disclosure, the angle $\alpha_1$ may be in the range of 120 to 180 degrees. The angle $\alpha_1$ may preferably be in a range from 160 to 180 or most preferably be in a range from 165 to 175.

Figure 18:
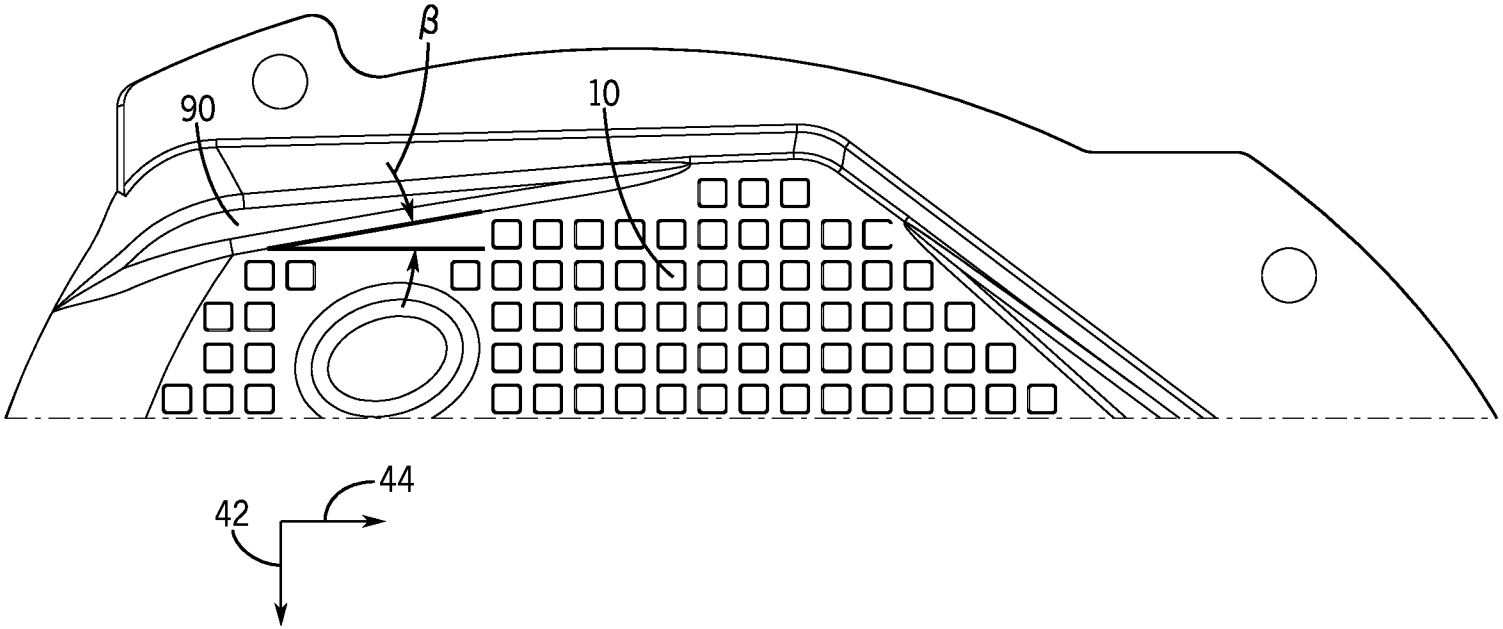
FIG. 18 is a top view of a platform surface and an angled surface.

FIG. 18 is a top view image of the angled surface 90 and the platform surface 10 of FIG. 15. The angle between the second horizontal axis 44 and the angled surface is denoted by β and is equal to 9 degrees in FIG. 18. A preferred range for β is between 0 and 20 degrees. A more preferred range of β is between 5 and 15 degrees. Having the angle β being greater than zero is to account for a typical human thumb lying at an angle relative the remaining fingers and the possibility of the thumb lying at an angle relative to the second horizontal axis in an embodiment of this disclosure.

Figure 19:
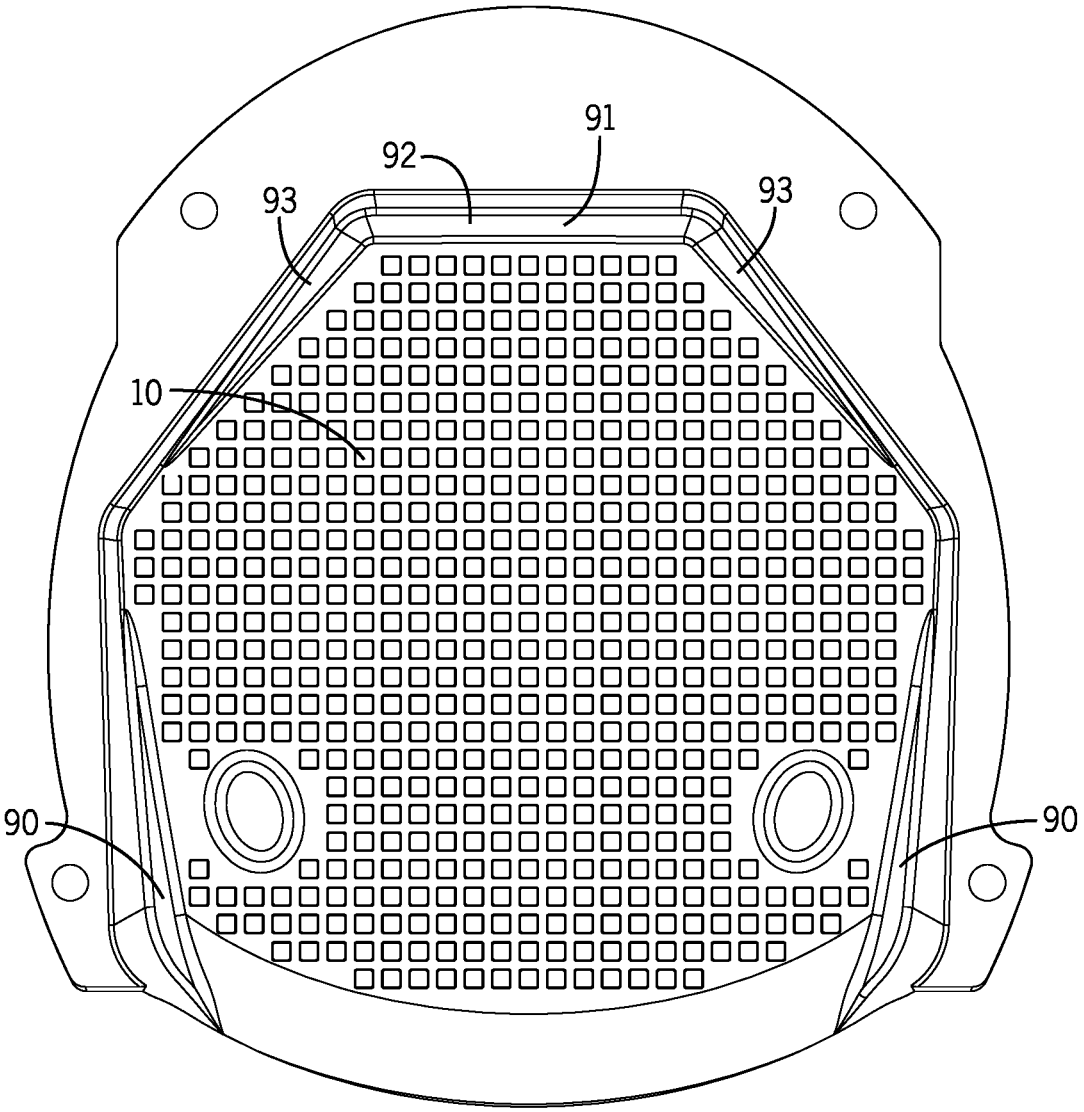
FIG. 19 is a view of a platform surface.

FIG. 19 is a top view image of platform surface 10 and a pair of angled surfaces 90 similar to that in FIG. 15. In addition, the embodiment of this disclosure of FIG. 19 includes an angled surface 91 at the rear of the platform surface 10. The angled surfaces 90 of FIGS. 15 through 19 may allow light to reflect and impinge light onto the thumbs. The angled surface 91 of FIG. 19 may allow light to reflect and impinge light onto the ends of the nails. The angled surface 91 has a central section 92 and two side sections 93.

Figure 20:
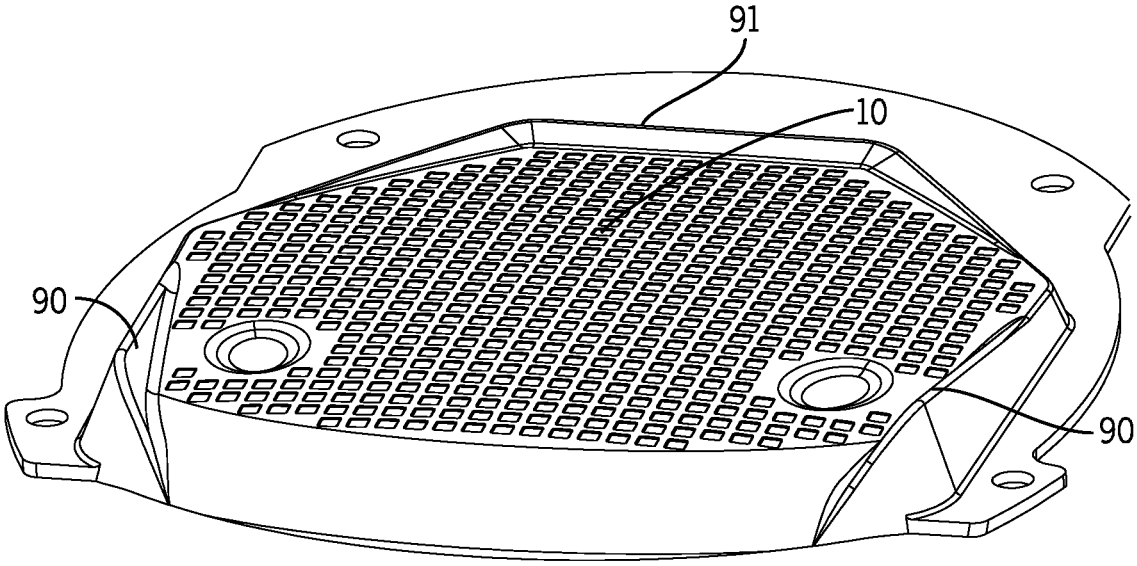
FIG. 20 is a perspective view of the platform surface depicted in FIG. 19.
Figure 21:
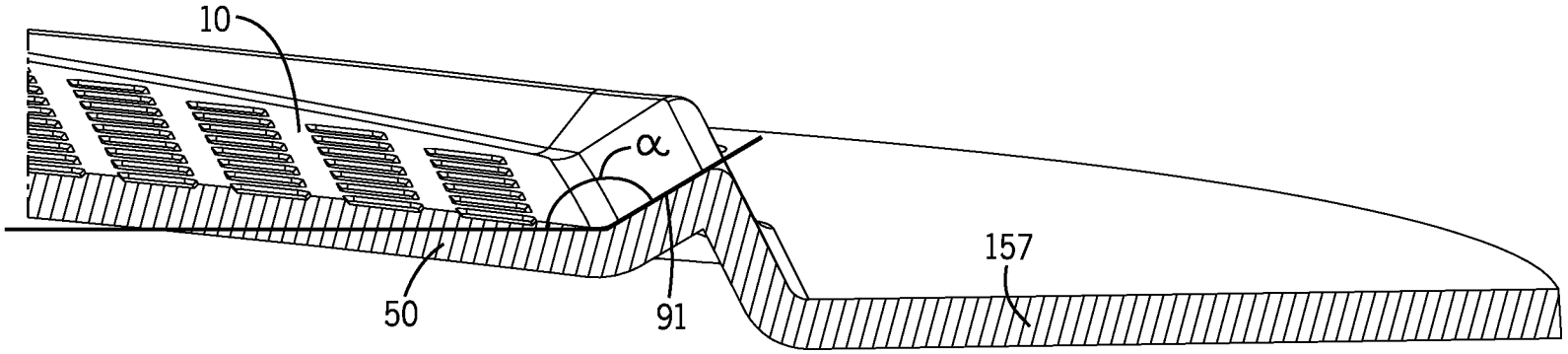
FIG. 21 is a sectioned side view of the platform surface and the angled surface at the rear of the platform surface depicted in FIG. 19.

FIG. 20 contains a perspective view of the embodiment of FIG. 19. The side view of FIG. 21 is a cross sectioned view of the rear angled surface, 91 and the platform surface 10. The cross section is in a plane 157 perpendicular to the first horizontal axis, 42. The angle between the base plane 50 and the rear angled surface 91 within the plane 157 is denoted by a in FIG. 21 and is equal to 130 degrees. In other embodiments of this disclosure, the angle α between the rear angled surface 91 and the may be in the range of 120 to 170 degrees. The angle α may preferably be in a range from 100 to 150 or most preferably be in a range from 110 to 140.

The foregoing illustrated embodiments are provided to illustrate the structural and functional principles of the nail lamp of the present disclosure and are not intended to be limiting. To the contrary, the principles of the present disclosure are intended to encompass any and all changes, alterations and/or substitutions within the spirit and scope of the claims, drawings and specification. For example, any features of any of the nail lamp systems either in FIGS. 1 through 21 or discussed in the text of this disclosure may be incorporated into any of the other nail lamp systems in FIGS. 1 through 21 or discussed in the text of this disclosure without deviating from the scope of the present disclosure.

What is claimed is:

1. A nail lamp, comprising:

one or more light sources;

a housing;

a nail treatment space defined by at least a first and a second surface, one or more of the first and second surfaces associated with the one or more light sources, said at least first and second surfaces forming an opening of the nail treatment space configured to allow insertion of at least one nail of a user, said nail treatment space further defined by a nail treatment space outer boundary, said nail treatment space outer boundary including a front boundary, a rear boundary, a left boundary and a right boundary;

a vertical axis, said vertical axis having a positive direction defined from one of the first or second surfaces of the nail treatment space to the other of the first and second surfaces carrying the one or more light sources;

a first angled surface, said first angled surface located near the nail treatment space outer boundary, and said first angled surface oriented in the positive direction of the vertical axis and towards the nail treatment space, wherein the first angled surface is oriented upward, which reflects light from the perimeter of the nail treatment space towards the center of the nail treatment space;

a first horizontal axis, said first horizontal axis perpendicular to the vertical axis and said first horizontal axis having a positive direction defined by the distance from the left boundary to the right boundary;

a second horizontal axis, said second horizontal axis perpendicular to the vertical axis and the first horizontal axis; and a base plane defined by the intersection of the first horizontal axis and the second horizontal axis, wherein said first angled surface is oriented at an angle of between 110 degrees and 160 degrees relative to the base plane; and at least two reflectors integral with one of said at least first and second surfaces;

wherein said nail treatment space is sized to allow insertion of at least one nail of a user, wherein each of said light sources is adjacent to a different one of said reflectors.

2. The nail lamp of claim 1, wherein the first angled surface is located at one of the left boundary or the right boundary of the nail treatment space, and a second angled surface is located at the other of the left boundary and the right boundary of the nail treatment space.

3. The nail lamp of claim 1, wherein said first angled surface is oriented at an angle between 120 and 150 degrees relative to the base plane.

4. The nail lamp of claim 1, wherein said first angled surface is oriented at an angle between 130 and 140 degrees relative to the base plane.

5. The nail lamp of claim 1, wherein said first angled surface is oriented at an angle between about 110 and 130 degrees relative to the base plane in a plane perpendicular to the first horizontal axis.

6. The nail lamp of claim 1, wherein said first angled surface is oriented at an angle between about 165 and 175 degrees relative to the base plane in a plane perpendicular to the second horizontal axis.

7. The nail lamp of claim 1, wherein the first angled surface is oriented at an angle of between about 0 and 15 degrees relative to the second horizontal axis.

8. The nail lamp of claim 1, wherein the angled surface is adjacent to the left boundary, the right boundary and the rear boundary.

9. The nail lamp of claim 1, further comprising a platform surface located below the nail treatment region, said platform surface comprising a thumb marking configured for placement of a thumb.

10. The nail lamp of claim 9, wherein the angled surface is less than 4 centimeters from the thumb marking.

11. The nail lamp of claim 9, wherein at least a portion of the angled surface is located at a lower position along the vertical axis than the thumb marking.

12. The nail lamp of claim 9, wherein the angled surface is adjacent to the platform surface.

13. The nail lamp of claim 1, wherein the lamp accommodates an at least one user nail.

14. The nail lamp of claim 1, wherein the at least one user nail is found on the user's hand or foot.

* * * * *